US005575252A

United States Patent [19]

Bauer et al.

[11] Patent Number: 5,575,252

[45] Date of Patent: Nov. 19, 1996

[54] RECIPROCATING INTERNAL COMBUSTION ENGINE

[75] Inventors: Lothar Bauer, Köln; Herbert Schleiermacher, Brühl; Werner Lemme, Rösrath; Heinz W. Fuchs, Remscheid, all of Germany

[73] Assignee: Klöckner-Humboldt-Deutz AG, Cologne, Germany

[21] Appl. No.: 358,081

[22] Filed: Dec. 15, 1994

[30] Foreign Application Priority Data

Dec. 15, 1993 [DE] Germany ..... 43 42 802.9

[51] Int. Cl.[6] ..... F01M 11/02

[52] U.S. Cl. ..... 123/196 R; 123/196 AB; 123/DIG. 1

[58] Field of Search ..... 123/DIG.1, 6, 123/7, 196 R, 198 C

[56] References Cited

U.S. PATENT DOCUMENTS 1,556,859 10/1925 L'Orange ..... 123/DIG. 1
4,135,478 7/1979 Rassey ..... 123/DIG. 6
4,198,947 4/1980 Rassey ..... 123/DIG. 6
5,429,080 7/1994 Pong ..... 123/198 C

OTHER PUBLICATIONS

"Motortechnischen Zeitschrift 1990", Heft 1.

*Primary Examiner*—Erick R. Solis
*Attorney, Agent, or Firm*—Hadaway Law Firm, P.A.; Charles L. Schwab

[57] ABSTRACT

This invention relates to a reciprocating internal combustion engine having a cylinder crankcase in which a crankshaft is rotatably supported, to which crankshaft there is flexibly joined at least one connecting rod having a piston guided in a cylinder liner, the crankcase having fittings of an oil circulation system and various attached parts in a number independent of the number of cylinders. The crankcases with various numbers of cylinders can be cast, machined and assembled at the lowest possible cost because groups of fittings and attached parts have spacings to one of the two ends of the various cylinder crankcases (1) that remain constant.

4 Claims, 1 Drawing Sheet

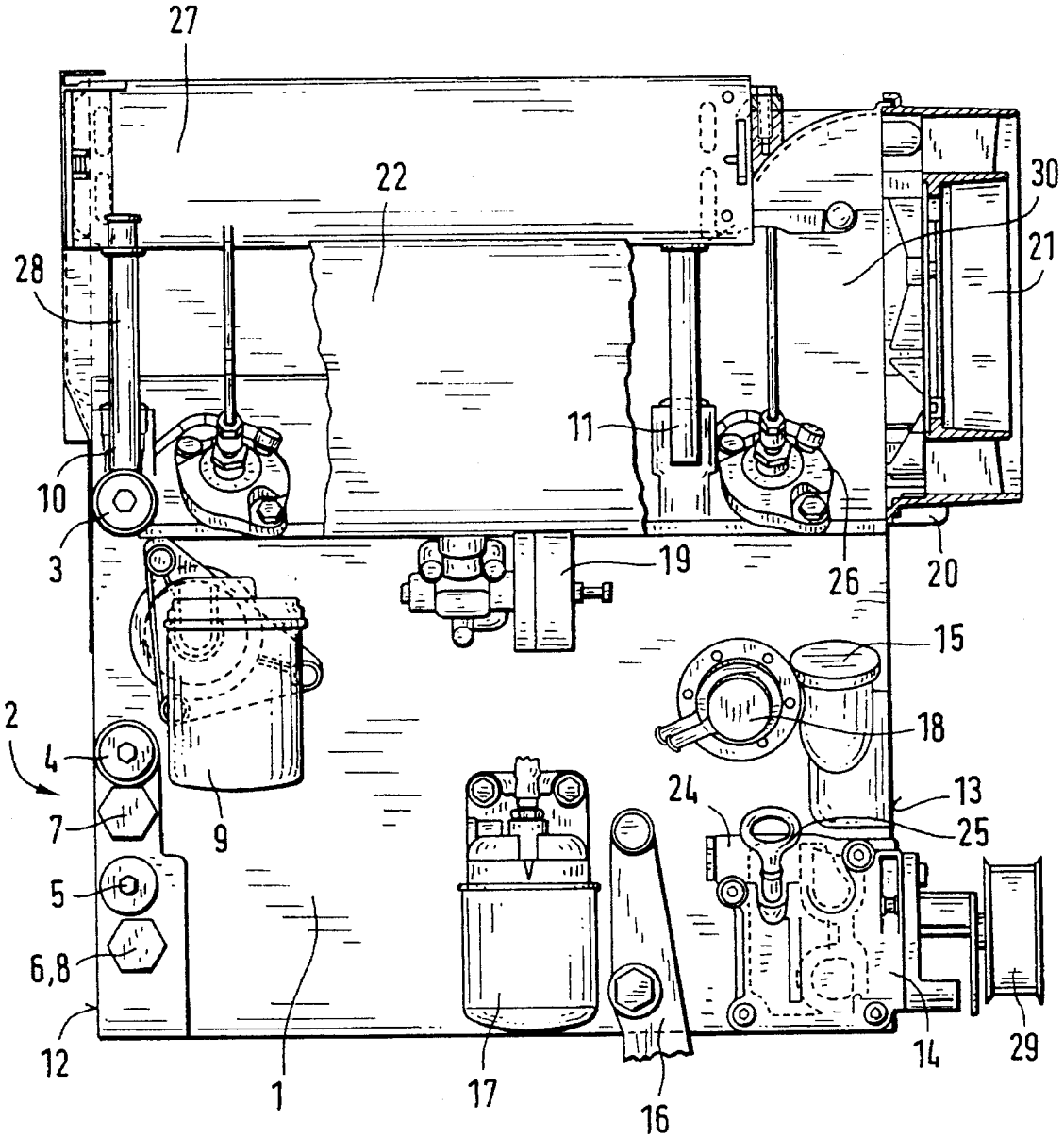
27
22
30
21
28
11
10
3
19
26
20
15
18
2
4
24
13
7
9
25
5
6,8
12
1
17
16
14
29

RECIPROCATING INTERNAL COMBUSTION ENGINE

RELATED APPLICATIONS

In a related U.S. patent application Ser. No. 08/358,082 field Dec. 15, 1994, and assigned to the assignee of this application, a valve strip of oil fittings are positioned on an engine crankcase.

TECHNICAL FIELD

This invention relates to a reciprocating internal combustion engine having a cylinder crankcase and particularly to the manner of attaching lubrication fittings and other parts to the crankcase.

PRIOR ART STATEMENT

In the Motortechnische Zeitschrift publication, 1990, Number 1, page 34, a reciprocating internal combustion engine is provided with fittings of an oil circulation system and various attached parts, which are arranged on a side wall of the cylinder crankcase. This internal combustion engine is constructed with various numbers of cylinders.

OBJECTS AND SUMMARY OF THE INVENTION

It is an object of the invention to create, for the reciprocating internal combustion engine of the stated type, crankcases for various numbers of cylinders which are to be cast, machined and assembled at the lowest possible cost. All fittings of the oil circulation system and all attached parts have a fixed, constant position in relation to the ends of the various cylinder crankcases. By this means, the casting, machining and assembly device is the same for all crankcases in relation to the fittings of the oil circulation system and the attached parts. In relation to the crankcase with the minimum number of cylinders, the various numbers of cylinders dictate only the displacement of the fabrication and assembly devices by the spacing of each additional cylinder. By this means, a simple conversion of the crankcase fabrication and assembly to the various numbers of cylinders is achieved.

It is advantageous that those attached parts and fittings that are connected to one another by means of external or internal lines or cables are in each case oriented to the same end of the various cylinder crankcases. Because the spacings of the fittings or attached parts to be connected are equal in all of the crankcases regardless of the number of cylinders, the connecting lines and cables are also identically alike for the group of crankcases having a various number of cylinders. By this means, the fabrication cost is substantially reduced. The number of spare parts is also decreased, and assembly errors are eliminated.

It has proved advantageous that a valve strip, having an oil thermostat, a pressurizer valve, a heating valve, an anti-draining valve, a heating supply hole and a heating return hole, and an oil filter as well as an oil cooler supply hole are positioned at the flywheel end of the cylinder crankcase. Because these fittings and attached parts are functionally connected in the oil circulation system of the reciprocating internal combustion engine, they are also in flow connection via an appropriate line, designed alike for crankcases with different numbers of cylinders.

It is also advantageous that an oil cooler return hole, an oil pump having a pressure relief valve and an oil dipstick, an oil filler neck, an engine mount arranged on each side of the engine, a fuel filter, a fuel pump, a full load stop dependent on the charge pressure, a regulator, and oil pressure and oil temperature sensors are positioned at the end of the cylinder crankcase opposite the flywheel. The fuel filter and the fuel pump are connected by means of a line which is of the same configuration regardless of the number of cylinders. Likewise, the full load stop dependent on the charge pressure, having a charge line, and the oil pressure and oil temperature sensors via cables, having the same line and cable harness for all the group of crankcases having various numbers of cylinders.

The parts and fittings attached to the engine which require maintenance and servicing are arranged outside a cooling air guiding hood (22), which extends from a cooling air fan over the length of the cylinder crankcase, and accordingly these attached parts and fittings are accessible without removal of the cooling air hood. This is especially important in case of adjustments or inspections that must be performed with the engine running, for only with the cooling air guiding hood installed is proper cooling and thus trouble-free engine operation possible.

There are advantages in having the valve strip, which includes the pressurizer valve, and the heating valve, the anti-draining valve, the heating supply hole and the heating return hole, the oil filter, the oil pump, the oil filler neck, the engine mounts, the fuel filter, the fuel pump, the full load stop dependent on the charge pressure, and the regulator all positioned outside the cooling air guiding hood. By this arrangement, the regulator and the full load stop dependent on the charge pressure can be adjusted while the engine is running and the function of the fuel pump can be checked. It is also advantageous that the oil filter and fuel filter can be changed without removal of other engine components. The same holds true for the connection or disconnection of the oil heating unit. Maintenance and inspection of the various oil valves is facilitated by means of their location outside the cooling air guiding hood.

BRIEF DESCRIPTION OF THE DRAWINGS

One embodiment of the invention is illustrated in the single Figure of the drawings which is a side view of a reciprocating internal combustion engine with the cooling air guiding hood partially cut away.

DETAILED DESCRIPTION OF THE DRAWINGS

Illustrated in the single drawing Figure is a side view of a cylinder crankcase (1) with its flywheel end (12) and its end (13) opposite the flywheel. Provided at the flywheel end (12) are a valve strip (2) with an oil thermostat (3), a pressurizer valve (4), a heating valve (5), an anti-draining valve (6), a heating supply hole (7) and a heating return hole (8), as well as an oil filter (9) and the oil cooler supply hole (10). These parts are in flow connection via an internal cast connecting line, not illustrated. The remaining attached parts and fittings, specifically an oil pump (14), an oil filler neck (15), an engine mount (16), a fuel filter (17), a fuel pump (18), a full load stop dependent on the charge pressure [CPS] (19), a regulator (20), a cooling air fan (21) and an oil cooler return hole (11) are positioned at the end (13) of the cylinder crankcase (1) opposite the flywheel. The fuel filter (17) is connected to the fuel pump (18) by means of a connecting line, not illustrated, and the CPS (19) is connected to the charge line, not illustrated, via a line, likewise not illustrated. The oil pump (14), which is driven by a drive wheel (29), has an oil dipstick (25) and a pressure relief valve (24). The oil filler neck (15) allows the addition of oil. A cooling air fan (21) delivers cooling air into a cooling air space (30), which is formed by the cylinder crankcase (1), a cooling air guiding hood (22) and an air-cooled oil cooler (27). The oil cooler (27) is in flow connection with the oil circulation system of the cylinder crankcase (1) via the oil cooler supply hole (10), the oil cooler return hole (11) and two insert pieces (28). The insert pieces can be provided with internal means to induce turbulence and with external cooling fins which act as supplementary oil coolers. Fuel injection pumps (26) are covered by the cooling air guiding hood (22), which injection pumps are assigned to each cylinder and are connected via injection lines to the respective injection valves, not illustrated. The covering of the injection units by means of the cooling air guiding hood offers acoustical advantages. Because the injection system does not require frequent maintenance, its covering does not give rise to significant operational disadvantages. All other attached parts and fittings which require maintenance or adjustment lie outside the cooling air guiding hood and are therefore accessible without disassembly of the hood.

The arrangement of the fittings of the oil circulation system and of the attached parts on the engine crankcase according to the invention offers the advantage that the same devices can be employed for the numbers of cylinders under consideration (two, three, four) for the casting, machining and final assembly of these parts for all the engines having these various numbers of cylinders. All that is necessary in manufacture is to position the crankcases differently in accordance with the number of cylinders in each crankcase. In this fashion, the fabrication and assembly cost is minimized. Since groups of connecting lines and cables are alike for all the crankcases regardless of the numbers of cylinders, the number of spare parts is also minimized.

What is claimed is:

1. A multiple cylinder reciprocating internal combustion engine comprising:

a cylinder crankcase having at least two in-line cylinders, said crankcase having a flywheel end and a second end opposite said flywheel end;

a crankshaft supported in said crankcase;

piston guided in each of said cylinders;

a connecting rod connecting each of said pistons to said crankshaft;

fittings of an oil circulation system and other attached parts formed on one lateral side of said crankcase adjacent said cylinder nearest said second end opposite said flywheel end of said crankcase 1), each fitting and each attached part having a predetermined spacing to said second end opposite to said flywheel end of said crankcase (1) that remains constant regardless of the number of cylinders in said crankcase and said fittings of said oil circulation system and attached parts formed on said crankcase (1) including an oil cooler return hole (11), an oil pump (14) having a pressure relief valve (24), an oil dipstick (25), and oil filler neck (15), a fuel filter (17), a fuel supply pump (18), a full load stop dependent on a charge pressure (19) and oil pressure and oil temperature sensors, said attached parts having the same positions relative to said second end in all versions of said engine.

2. The reciprocating internal combustion engine of claim 1 wherein said engine includes a cooling air fan (21) and a cooling air guiding hood (22) extending over the length of said cylinder crankcase (1), and wherein said attached parts and fittings requiring routine maintenance and servicing are arranged outside said cooling air guiding hood (22).

3. An internal combustion engine having at least three in-line cylinders comprising:

a unitary cylinder crankcase (1) having a flywheel end (12) and a second end (13) opposite said flywheel end (12);

a crankshaft supported in said crankcase;

a piston guided in each of said cylinders;

a connecting rod connecting each of said pistons to said crankshaft;

a valve strip (2) formed on said flywheel end (12) of said crankcase (1) laterally adjacent the cylinder nearest said flywheel end (12) of said crankcase including an oil thermostat (3), a pressure valve (4), a heating valve (5), an anti-draining valve (6), a heating supply hole (7), a heating return hole (8), an oil filter (9) and an oil cooler supply hole (10) and fittings of an oil circulation system and other attached parts mounted on said second end (13) of said crankcase (1) including an oil pump (14) an oil cooler return hole (11), an oil dipstick (25) an oil filler neck (15), a fuel supply pump (18) and a fuel filter (17), said fittings and attached parts being positioned laterally adjacent the cylinder nearest said second end of said crankcase.

4. The engine of claim 3 wherein said fittings and said attached parts are disposed on one lateral side of said crankcase (1).

* * * * *